US005322831A

United States Patent [19]

Minami et al.

[11] Patent Number: 5,322,831

[45] Date of Patent: Jun. 21, 1994

[54] THERMAL RECORDING SHEET

[75] Inventors: Toshiaki Minami; Toshio Kaneko, both of Tokyo, Japan

[73] Assignee: Jujo Paper Co., Ltd., Tokyo, Japan

[21] Appl. No.: 22,261

[22] Filed: Feb. 25, 1993

[30] Foreign Application Priority Data

Feb. 28, 1992 [JP] Japan ..... 4-43384

[51] Int. Cl.[5] ..... B41M 5/30

[52] U.S. Cl. ..... 503/209; 503/208; 503/216; 503/225

[58] Field of Search ..... 427/150-152; 503/208, 209, 225, 200, 225, 200, 226

[56] References Cited

U.S. PATENT DOCUMENTS

| | | | |
|---|---|---|---|
| 4,539,578 | 9/1985 | Igarashi et al. | 503/207 |
| 4,644,375 | 2/1987 | Satake et al. | 503/209 |
| 4,742,042 | 5/1988 | Hiraishi et al. | 503/201 |

FOREIGN PATENT DOCUMENTS

| | | | |
|---|---|---|---|
| 57227990 | 7/1984 | Japan | 503/227 |
| 5864569 | 1/1985 | Japan | 503/227 |
| 58120209 | 1/1985 | Japan | 503/227 |
| 02-227286 | 9/1990 | Japan | 503/216 |
| 3-178972 | 8/1991 | Japan | 503/216 |
| 64315178 | 8/1991 | Japan | 503/227 |
| 04-191087 | 7/1992 | Japan | 503/216 |
| 04-275178 | 9/1992 | Japan | 503/216 |

*Primary Examiner*—B. Hamilton Hess
*Attorney, Agent, or Firm*—Sherman and Shalloway

[57] ABSTRACT

A thermal recording sheet having a thermal color developing layer containing a color developer and a colorless or pale colored basic chromogenic dye, which further contains a stabilizer of Formula (I) and a sensitizer of Formula (II) or Formula (III), thereby obtaining a high sensitivity and improved image stability:

Formula (I)

-continued (I)

wherein A indicates or $R^1$ and $R^2$ individually indicate hydrogen or methyl; $\alpha$ is 0 or an integer from 1 to 5; $\beta$ and $\gamma$ individually indicate an integer from 1 to 5; B indicates C and D individually indicate chlorine, bromine, (Abstract continued on next page.)

methyl, methoxy, or ethoxy; and m and n individually indicate 0, 1, or 2;
Formula (II)
-continued
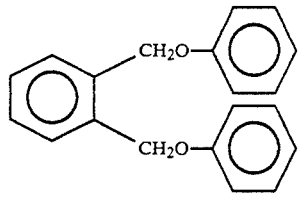
(II)
Formula (III)
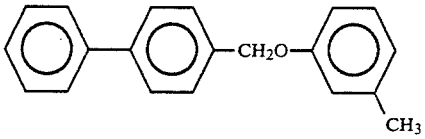
(III)
8 Claims, No Drawings

THERMAL RECORDING SHEET

FIELD OF THE INVENTION

This invention relates to a thermal recording sheet with superior heat resistance, water resistance, and oil resistance.

DESCRIPTION OF THE PRIOR ART

In general, in thermal recording sheets, a normally colorless or pale colored basic chromogenic dye and an organic color developer such as a phenolic substance are individually pulverized into fine particles, mixed, and a binder, a filler, a sensitivity improver, a slip agent, and other additives are added to obtain a coating color, which is coated on a substrate such as paper, synthetic paper, films, plastics, and the like. The thermal recording sheet enables color recording by a momentary chemical reaction caused by heating with a thermal pen, a thermal head, a hot stamp, laser light, or the like.

These thermal recording sheets are applied in a variety of areas such as measurement recorders, computer terminal printers, facsimiles, automatic ticket vendors, and bar-code labels, however, with recent diversification and improvement of these recording devices, requirements to the thermal recording sheets have become stricter. For example, with increasing recording speed, it is required to obtain a high-concentration, sharp color image even with a small heat energy and, in addition, to have improved storage stability in terms of light resistance, weather resistance, and oil resistance.

Prior art examples of thermal recording sheets include, for example, thermal recording materials disclosed in Japanese Patent Publications 43-4160 and 45-14039, however, these prior art thermal recording materials have been defective, among others, in that the thermal response is low and a sufficient color developing density is not obtained in high-speed recording.

To improve such defects, high-sensitivity dyes such as using 3-N-methyl-N-cyclohexylamino-6-methyl-7-anilinofluorane (Japanese Patent Laid-open Publication 49-10912) and 3-dibutylamino-6-methyl-7-anilinofluorane (Japanese Patent Laid-open Publication 59-190891) have been developed, and technologies using 1,7-bis (hydroxyphenylthio)-3,5-dioxaheptane (Japanese Patent Laid-open Publication 59-106456), 1,5-bis (4-hydroxyphenylthio)-3-oxaheptane (Japanese Patent Laid-open Publication 59-116262), and 4-hydroxy-4'-isopropoxydiphenylsulfone (Japanese Patent Publication 63-46067) as color developers for higher speed and sensitivity have been disclosed.

OBJECT OF THE INVENTION

However, while these thermal recording sheets are high in sensitivity, they involve problems in heat resistance causing reduction in image density when stored at high temperatures.

Furthermore, since the recording image is inferior in storage stability, disadvantages still remain in that water or oil components tend to adhere to the developed color image, and considerable reduction in image density or discoloration of the image occurs when contacting with plasticizers (DOP, DOA, etc.) contained in wrapping films such as PVC films.

Therefore, it is a primary object of the present invention to provide a thermal recording sheet which is high in sensitivity and superior in heat resistance, water resistance, and oil resistance.

SUMMARY OF THE INVENTION

In accordance with the present invention, there is provided a thermal recording sheet, characterized in that a specific epoxidized diphenylsulfone derivative of Formula (I) as a stabilizer and at least one of compounds of Formula (II) and Formula (III) as a sensitizer are contained in a thermal color developing layer, thereby solving all of the above problems:

Formula (I)

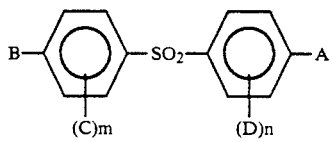

(I)

wherein A indicates

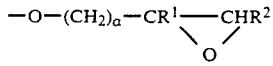

or

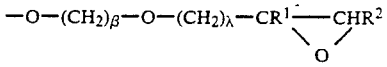

$R^1$ and $R^2$ individually indicate hydrogen or methyl; $\alpha$ is 0 or an integer from 1 to 5; $\beta$ and $\gamma$ individually indicate an integer from 1 to 5; B indicates

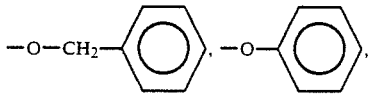

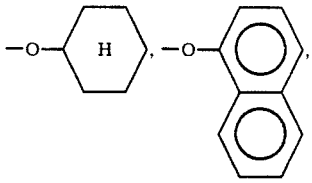

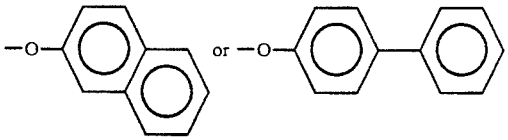

C and D individually indicate chlorine, bromine, methyl, methoxy, or ethoxy; and m and n individually indicate 0, 1, or 2;

Formula (II)

-continued
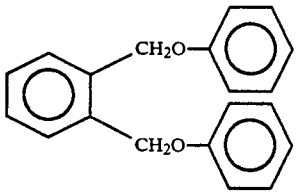
Formula (III)
(II)
-continued
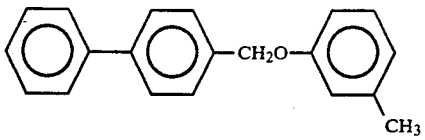
(III)
Examples of the epoxidized diphenylsulfone derivative used in the present invention include, for example, the following compounds.
1.
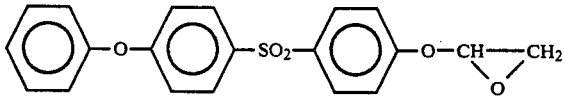
2.
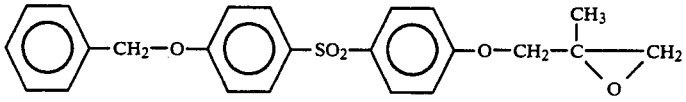
3.
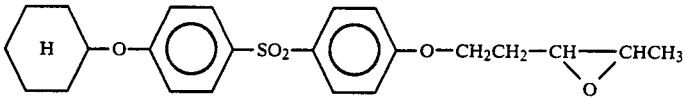
4.
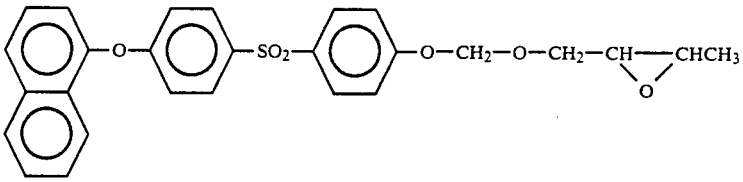
5.
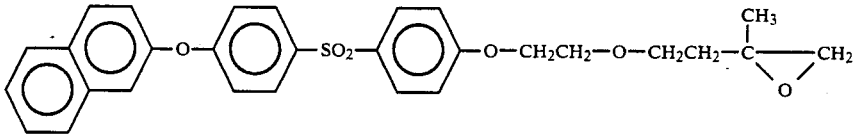
6.
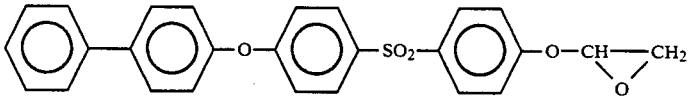
7.
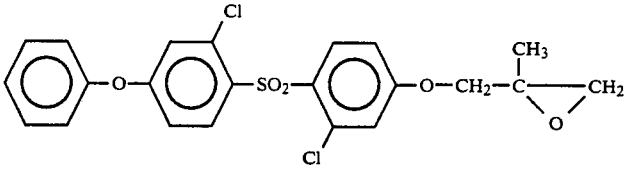
8.
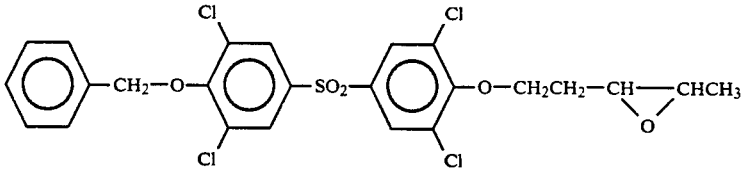
9.
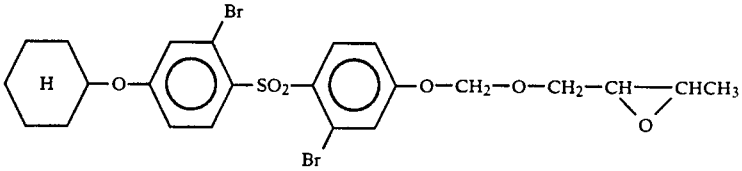

-continued

10.

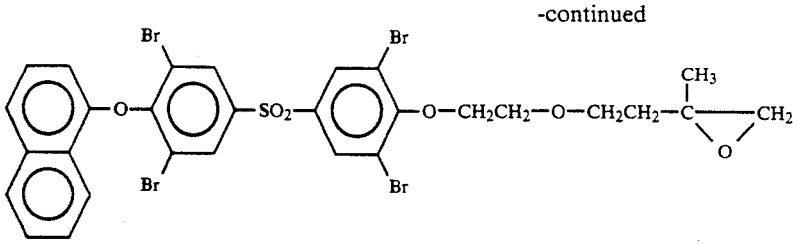

11.

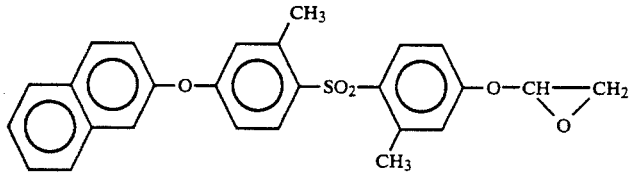

12.

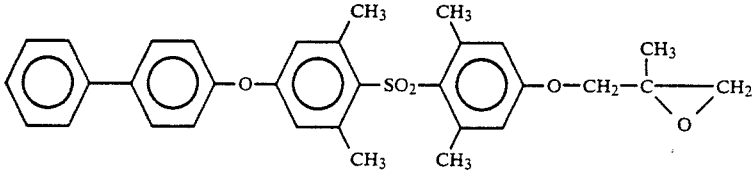

13.

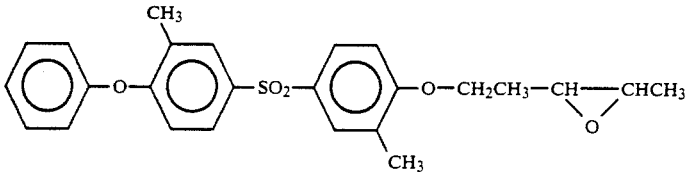

14.

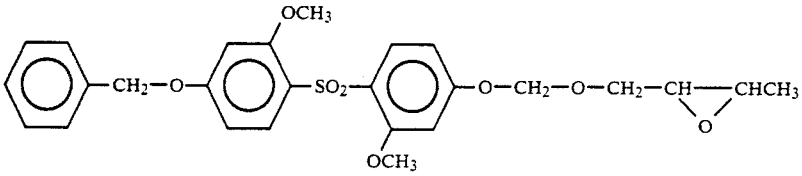

15.

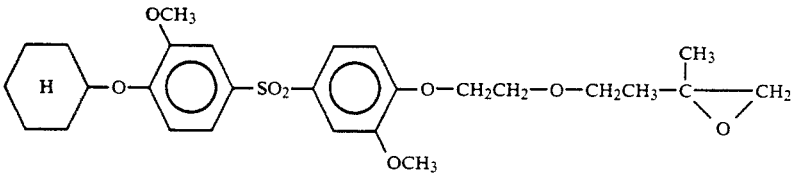

16.

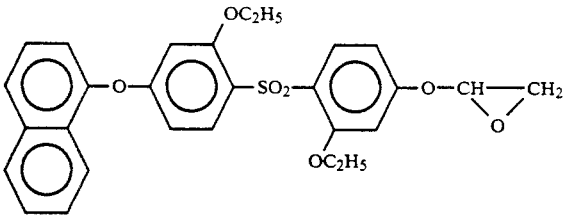

17.

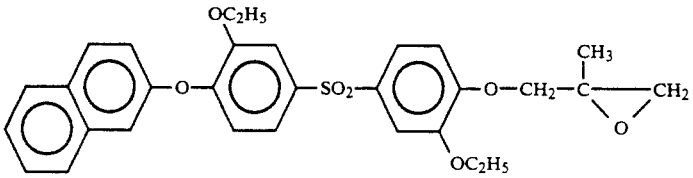

Of course, the epoxidized diphenylsulfone derivative is not limited to these compounds, and two or more compounds thereof may be used in combination as needed.

In the present invention, the color developer includes, for example, bisphenol A and its derivatives, 4-hydroxybenzoic esters, 4-hydroxyphthalic diesters, phthalic monoesters, bis(hydroxyphenyl) sulfides, 4-hydroxyarylsulfones, 4-hydroxyphenylarylsulfonates, 1,3-di[2-(hydroxyphenyl)-2-propyl]-benzenes, 4-hydroxybenzoyloxybenzoic ester, and bisphenolsulfones. Practical examples thereof are shown below:

Bisphenol A and its derivatives
4,4' -Isopropylidenediphenol (bisphenol A)
4-4' -Cyclohexylidenediphenol
p,p'-(1-Methyl-n-hexylidene) diphenol
1,7-Di (4-hydroxyphenylthio)-3,5-dioxaheptane.

4-Hydroxybenzoic esters
Benzyl 4-hydroxybenzoate
Ethyl 4-hydroxybenzoate
Propyl 4-hydroxybenzoate
Isopropyl 4-hydroxybenzoate
Butyl 4-hydroxybenzoate
Isobutyl 4-hydroxybenzoate
Methylbenzyl 4-hydroxybenzoate 4-Hydroxyphthalic diesters
Dimethyl 4-hydroxyphthalate
Diisopropyl 4-hydroxyphthalate
Dibenzyl 4-hydroxyphthalate
Dihexyl 4-hydroxyphthalate Phthalic monoesters
Monobenzyl phthalate
Monocyclohexyl phthalate
Monophenyl phthalate
Monomethylphenyl phthalate
Monoethylphenyl phthalate
Monopropylbenzyl phthalate
Monohalogenbenzyl phthalate
Monoethoxybenzyl phthalate Bis-(hydroxyphenyl) sulfides
Bis-(4-hydroxy-3-tert-butyl-6-methylphenyl) sulfide
Bis-(4-hydroxy-2,5-dimethylphenyl) sulfide
Bis-(4-hydroxy-2-methyl-5-ethylphenyl) sulfide
Bis-(4-hydroxy-2-methyl-5-isopropylphenyl) sulfide
Bis-(4-hydroxy-2,3-dimethylphenyl) sulfide
Bis-(4-hydroxy-2,5-dimethylphenyl) sulfide
Bis-(4-hydroxy-2,5-diisopropylphenyl) sulfide
Bis-(4-hydroxy-2,3,6-trimethylphenyl) sulfide
Bis-(2,4,5-trihydroxyphenyl) sulfide
Bis-(4-hydroxy-2-cyclohexyl-5-methylphenyl) sulfide
Bis(2,3,4-trihydroxyphenyl) sulfide
Bis-(4,5-dihydroxy-2-tert-butylphenyl) sulfide
Bis-(4-hydroxy-2,5-diphenylphenyl) sulfide
Bis-(4-hydroxy-2-tert-octyl-5-methylphenyl) sulfide 4-Hydroxyphenylarylsulfones
4-Hydroxy-4'-isopropoxydiphenylsulfone
4-Hydroxy-4'-propoxydiphenylsulfone
4-Hydroxy-4'-n-butyloxydiphenylsulfone
4-Hydroxy-4'-n-propoxydiphenylsulfone 4-Hydroxyphenylarylsulfonates
4-Hydroxyphenylbenzenesulfonate
4-Hydroxyphenyl-p-tolylsulfonate
4-Hydroxyphenylmethylenesulfonate
4-Hydroxyphenyl-p-chlorobenzenesulfonate
4-Hydroxyphenyl-p-tert-butylbenzenesulfonate
4-Hydroxyphenyl-p-isopropoxybenzenesulfonate
4-Hydroxyphenyl-1'-naphthalenesulfonate
4-Hydroxyphenyl-2'-naphthalenesulfonate 1,3-Di[2-(hydroxyphenyl)-2-propyl]benzenes
1,3-Di[2-(4-hydroxy-3-alkylphenyl)-2-propyl]benzene
1,3-Di[2-(2,4-dihydroxyphenyl)-2-propyl]benzene
1,3-Di[2-(2-hydroxy-5-methylphenyl)-2-propyl]benzene Resorcinols
1,3-Dihydroxy-6(α,α-dimethylbenzyl)benzene 4-Hydroxybenzoyloxybenzoic esters
Benzyl 4-hydroxybenzoyloxybenzoate
Methyl 4-hydroxybenzoyloxybenzoate
Ethyl 4-hydroxybenzoyloxybenzoate
Propyl 4-hydroxybenzoyloxybenzoate
Butyl 4-hydroxybenzoyloxybenzoate
Isopropyl 4-hydroxybenzoyloxybenzoate
tert-Butyl 4-hydroxybenzoyloxybenzoate
Hexyl 4-hydroxybenzoyloxybenzoate
Octyl 4-hydroxybenzoyloxybenzoate
Nonyl 4-hydroxybenzoyloxybenzoate
Cyclohexyl 4-hydroxybenzoyloxybenzoate
β-Phenethyl 4-hydroxybenzoyloxybenzoate
Phenyl 4-hydroxybenzoyloxybenzoate
α-Naphthyl 4-hydroxybenzoyloxybenzoate
β-Naphthyl 4-hydroxybenzoyloxybenzoate
sec-Butyl 4-hydroxybenzoyloxybenzoate Bisphenolsulfones (I)
Bis-(3-1-butyl-4-hydroxy-6-methylphenyl)sulfone
Bis-(3-ethyl-4-hydroxyphenyl)sulfone
Bis-(3-propyl-4-hydroxyphenyl)sulfone
Bis-(3-methyl-4-hydroxyphenyl)sulfone
Bis-(2-isopropyl-4-hydroxyphenyl)sulfone
Bis-(2-ethyl-4-hydroxyphenyl)sulfone
Bis-(3-chloro-4-hydroxyphenyl)sulfone
Bis-(2,3-dimethyl-4-hydroxyphenyl)sulfone
Bis-(2,5-dimethyl-4-hydroxyphenyl)sulfone
Bis-(3-methoxy-4-hydroxyphenyl)sulfone
4-Hydroxyphenyl-2'-ethyl-4'-hydroxyphenylsulfone
4-Hydroxyphenyl-2'-isopropyl-4'-hydroxyphenylsulfone
4-Hydroxyphenyl-3'-isopropyl-4'-hydroxyphenylsulfone
4-Hydroxyphenyl-3'-sec-butyl-4'-hydroxyphenylsulfone
3-Chloro-4-hydroxyphenyl-3'-isopropyl-4'-hydroxyphenylsulfone
2-Hydroxy-5-t-butylphenyl-4'-hydroxyphenylsulfone
2-Hydroxy-5-t-aminophenyl-4'-hydroxyphenylsulfone
2-Hydroxy-5-t-isopropylphenyl-4'-hydroxyphenylsulfone
2-Hydroxy-5-t-octylphenyl-4'-hydroxyphenylsulfone
2-Hydroxy-5-t-butylphenyl-3'-chloro-4'-hydroxyphenylsulfone
2-Hydroxy-5-t-butylphenyl-3'-methyl-4'-hydroxyphenylsulfone
2-Hydroxy-5-t-butylphenyl-3'-isopropyl-4'-hydroxyphenylsulfone
2-Hydroxy-5-t-butylphenyl-3'-chloro-4'-hydroxyphenylsulfone
2-Hydroxy-5-t-butylphenyl-3'-methyl-4'-hydroxyphenylsulfone
2-Hydroxy-5-t-butylphenyl-3'-isopropyl-4'-hydroxyphenylsulfone
2-Hydroxy-5-t-butylphenyl-2'-methyl-4'-hydroxyphenylsulfone Bisphenolsulfonic acids (II)
4,4'-Sulfonyldiphenol
2,4'-Sulfonyldiphenol
3,3'-Dichloro-4,4'-sulfonyldiphenol
3,3'-Dibromo-4,4'-sulfonyldiphenol
3,3',5,5'-Tetrabromo-4,4'-sulfonyldiphenol
3,3'-Diamino-4,4'-sulfonyldiphenol Others
p-tert-Butylphenol
2,4-Dihydroxybenzophenone
Novolac type phenolic resin
4-Hydroxyacetophenone
p-Phenylphenol Benzyl-4-hydroxyphenylacetate
p-Benzylphenol In the present invention, it is also possible to use in combination with other fluorane-based leuco dyes as much as the effect of the present invention is not impaired, and some practical examples are shown below:

3-Diethylamino-6-methyl-7-anilinofluorane
3-(N-ethyl-p-toluidino)-6-methyl-7-anilinofluorane
3-(N-ethyl-N-isoamylamino)-6-methyl-7-anilinofluorane
3-Diethylamino-6-methyl-7-(o,p-dimethylanilino)fluorane
3-Pyrrolidino-6-methyl-7-anilinofluorane
3-Piperidino-6-methyl-7-anilinofluorane
3-(N-cyclohexyl-N-methylamino)-6-methyl-7-anilinofluorane
3-Diethylamino-7-(m-trifluoromethylanilino)fluorane
3-Dibutylamino-6-methyl-7-anilinofluorane
3-Diethylamino-6-chloro-7-anilinofluorane
3-Dibutylamino-7-(o-chloroanilino)fluorane
3-Diethylamino-7-(o-chloroanilino)fluorane.

Furthermore, as a sensitizer, fatty acid amides such as stearamide, palmitamide, or the like; ethylene-bisamide, montan wax, polyethylene wax, dibenzyl terephthalate, benzyl p-benzyloxybenzoate, di-p-tolylcarbonate, p-benzylbiphenyl, phenyl-α-naphthylcarbonate, 1,4-diethoxynaphthalene, phenyl-1-hydroxy-2-naphthoate, 1,2-di-(3-methylphenoxy) ethane, di(methylbenzyl)oxalate, β-benzyloxynaphthalene, 4-biphenyl-p-tolylether, or the like can be added as much as the effect of the present invention is not impaired.

The binder used in the present invention can be fully-saponified polyvinylalcohol with a polymerization degree of 200 to 1,900, partially-saponified polyvinylalcohol, carboxy-modified polyvinylalcohol, amide-modified polyvinylalcohol, sulfonic acid-modified polyvinylalcohol, and other modified polyvinylalcohols, hydroxyethylcellulose, methylcellulose, carboxymethylcellulose, styrene-maleic anhydride copolymer, styrene-butadiene copolymer, cellulose derivatives such as ethylcellulose and acetylcellulose, polyvinylchloride, polyvinylacetate, polyacrylamide, polyacrylic esters, polyvinylbutyral, polystyrene and its copolymers, polyamide resins, silicone resins, petroleum resins, terpene resins, ketone resins, and coumarone resins. These polymeric substances can be dissolved in water, and solvents such as alcohols, ketones, esters, hydrocarbons, and the like, or emulsified or dispersed in water or other media, or can be used in combination according to the quality requirements.

In the present invention, it is also possible to add known stabilizers based on metal salts (Ca, Zn) of p-nitrobenzoic acid or metal salts (Ca, Zn) of monobenzylphthalate in amounts not to impair the effect of the present invention.

Fillers used in the present invention can be inorganic or organic fillers such as silica, calcium carbonate, kaolin, calcinated kaolin, diatomaceous earth, talc, titanium oxide, aluminum hydroxide, or the like.

In addition to the above, it is possible to use release agents such as fatty acid metal salts, slip agents such as wax, benzophenone- or triazole-based ultraviolet absorbers, water resistant agents such as glyoxal, dispersants, defoamers, and the like.

The amounts of the stabilizer and the basic colorless dye used in the present invention and the types and amounts of other constituents are determined according to the required properties and recording adaptability, and are not specifically limited, but it is usually preferable to use 1 to 8 parts of the organic color developer, 0.25 to 2.5 parts of the stabilizer, 3 to 12 parts of the sensitizer, and 1 to 20 parts of fillers to 1 part of the basic colorless dye, and the binder is used in an amount of 10 to 25% the total solid.

The solution of the above composition can be coated on any type of substrate such as paper, synthetic paper, films, plastics, or the like to obtain the objective thermal recording sheet.

Furthermore, the sheet can be provided on the thermal color developing layer with an overcoating layer of a polymeric substance or the like to improve the storage stability.

Furthermore, an undercoating layer containing an organic or inorganic filler can also be provided under the thermal color developing layer in order to improve the storage stability and sensitivity.

The organic color developer, the basic colorless dye, and the materials which are added as needed are pulverized by a pulverizing machine such as a ball mill, an attriter, a sand grinder, or the like, or by an appropriate emulsifying apparatus to a particle diameter of several microns or less, and mixed with the binder and various additives according to the purpose to obtain a solution.

In the present invention, the reason why a combination of a specific stabilizer with a specific sensitizer gives the effect of the present invention is considered as follows.

First, the superior dynamic color developing ability is due to a high melt diffusion rate and a high saturation solubility of the sensitizer to the stabilizer of the present invention, thereby instantaneously forming a recording image by a momentary contact with a high-temperature thermal head.

The reason why the recording image has an extremely high stability in terms of heat resistance, water resistance, and oil resistance is explained as follows. In general, a thermal recording paper uses a basic colorless dye as an electron donor, and an organic acid substance such as a phenolic compound, an aromatic carboxylic acid, an organic sulfonic acid, or the like as an electron acceptor. Heat melting reaction of the basic colorless dye and the color developer is an acid-base reaction based on electron donation and acceptance, which forms a metastable "charge transfer complex", thereby obtaining a color image. It is hypothesized that, in this case, by containing an epoxidized diphenylsulfone derivative in the system, the epoxy ring opens during the heat melting reaction, reacts with the sensitizer, the leuco dye, and the organic color developer to stabilize the recording image. In this reaction process, when a specific epoxidized diphenylsulfone derivative and a specific sensitizer are combined, the ring-opening reaction of the epoxy ring actively takes place, and as a result, stability of the color image is maintained even if the recording image is exposed to environmental conditions under which it is affected by water, oil, and heat for an extended period of time.

DESCRIPTION OF THE PREFERRED EMBODIMENTS

The present invention will now be described with reference to the embodiments. In the description, part means part by weight.

EXAMPLES 1

TEST NOS. 1-8

| | Part |
|---|---|
| Solution A (color developer dispersion) | |
| Color developer (Table 1) | 6.0 |
| 10% aqueous polyvinylalcohol solution | 18.8 |
| Water | 11.2 |
| Solution B (stabilizer dispersion) | |
| Diphenylsulfone derivative (Table 1) | 4.0 |
| 10% aqueous polyvinylalcohol solution | 5.0 |
| Water | 3.0 |
| Solution C (sensitizer dispersion) | |
| Sensitizer (Table 1) | 4.0 |
| 10% aqueous polyvinylalcohol solution | 5.0 |
| Water | 3.0 |
| Solution D (dye dispersion) | |
| 3-n-Dibutylamino-6-methyl-7-anilinofluorane | 2.0 |
| 10% aqueous polyvinylalcohol solution | 4.6 |
| Water | 2.6 |

The above solutions were individually ground by a sand grinder to an average particle diameter of 1 micron. Then, the dispersions were mixed in the following ratio to obtain a coating color.

| | |
|---|---|
| Solution A | 36.0 parts |
| Solution B | 12.0 |
| Solution C | 12.0 |
| Solution D | 9.2 |
| Kaolin clay (50% dispersion) | 12.0 |

The above coating color was coated on one side of a 50 g/m$^2$ base paper to an amount of 6.0 g/m$^2$ and dried, and the sheet was treated by a super-calender to a flatness of 500-600 seconds to obtain a thermal recording sheet.

COMPARATIVE EXAMPLE 1

TEST NOS. 9-11

| | Part |
|---|---|
| Solution E (color developer dispersion) | |
| 4-Hydroxy-4'-isopropoxydiphenylsulfone | 6.0 |
| 10% aqueous polyvinylalcohol solution | 18.8 |
| Water | 11.2 |
| Solution F (dye dispersion) | |
| 3-n-Dibutylamino-6-methyl-7-anilinofluorane | 2.0 |
| 10% aqueous polyvinylalcohol solution | 4.6 |
| Water | 2.6 |
| Solution D (stabilizer dispersion) | |
| Diphenylsulfone derivative (Table 1) | 4.0 |
| 10% aqueous polyvinylalcohol solution | 5.0 |

-continued

| | Part |
|---|---|
| Water | 3.0 |
| Solution H (sensitizer dispersion) | |
| Sensitizer (Table 1) | 4.0 |
| 10% aqueous polyvinylalcohol solution | 5.0 |
| Water | 3.0 |

The above solutions were individually ground by a sand grinder to an average particle diameter of 1 micron. Then, the dispersions were mixed in the following ratio to obtain a coating color, which was treated as in Example 1 to prepare a thermal recording sheet.

| | |
|---|---|
| Solution E | 36.0 parts |
| Solution F | 9.2 |
| Solution G | 12.0 |
| Solution H | 12.0 |
| Kaolin clay (50% dispersion) | 12.0 |

COMPARATIVE EXAMPLE 2

Test Nos. 12-13

| | Part |
|---|---|
| Solution E (color developer dispersion) | |
| 4-Hydroxy-4'-isopropoxydiphenylsulfone | 5.0 |
| 10% aqueous polyvinylalcohol solution | 18.8 |
| Water | 11.2 |
| Solution I (sensitizer dispersion) | |
| Sensitizer (Table 1) | 4.0 |
| 10% aqueous polyvinylalcohol solution | 5.0 |
| Water | 3.0 |
| Solution J (dye dispersion) | |
| 3-n-Dibutylamino-6-methyl-7-anilinofluorane | 2.0 |
| 10% aqueous polyvinylalcohol solution | 4.6 |
| Water | 2.6 |

The above solutions were individually ground by a sand grinder to an average particle diameter of 1 micron. Then, the dispersions were mixed in the following ratio to obtain a coating color, which was treated as in Example 1 to prepare a thermal recording sheet.

| | |
|---|---|
| Solution E | 36.0 parts |
| Solution I | 12.0 |
| Solution J | 9.2 |
| Kaolin clay (50% dispersion) | 12.0 |

The thermal recording sheets obtained in the above Example and Comparative Examples were tested for quality and properties. The test results are summarized in Table 1.

TABLE 1

Test Results

| | Test No. | Color developer | Stabilizer | Sensitizer |
|---|---|---|---|---|
| Example | 1 | 4-Hydroxy-4'-isopropoxydiphenylsulfone | Compound No. 2 | A |
| | 2 | Same as above | No. 5 | B |
| | 3 | Same as above | No. 9 | A |
| | 4 | 4-Hydroxy-4'-n-propoxydiphenylsulfone | No. 2 | A |
| | 5 | Same as above | No. 12 | B |
| | 6 | Same as above | No. 13 | A |
| | 7 | 4-Hydroxy-4'-n-butoxydiphenylsulfone | No. 2 | A |
| | 8 | Same as above | No. 17 | B |

TABLE 1-continued

| | | | | |
|---|---|---|---|---|
| Comp. Example 1 | 9 | 4-Hydroxy-4'-isopropoxydiphenylsulfone | No. 2 | C |
| | 10 | Same as above | No. 5 | D |
| | 11 | Same as above | No. 9 | E |
| Comp. Example 2 | 12 | Same as above | None | A |
| | 13 | Same as above | None | B |

| Test No. | Dynamic color developing density(1) | Heat resistance (2) Un-treated | Heat resistance (2) Treat-ed | Heat resistance (2) Reten-tion (%) | Water resistance (3) Un-treated | Water resistance (3) Treat-ed | Water resistance (3) Reten-tion (%) | Oil resistance (4) Un-treated | Oil resistance (4) Treat-ed | Oil resistance (4) Reten-tion (%) |
|---|---|---|---|---|---|---|---|---|---|---|
| Example | | | | | | | | | | |
| 1 | 1.05 | 1.05 | 1.03 | 98 | 1.05 | 0.98 | 93 | 1.05 | 0.96 | 91 |
| 2 | 1.04 | 1.04 | 1.02 | 98 | 1.04 | 0.98 | 94 | 1.04 | 0.96 | 92 |
| 3 | 1.03 | 1.03 | 1.02 | 99 | 1.03 | 0.93 | 90 | 1.03 | 0.96 | 93 |
| 4 | 1.02 | 1.02 | 0.99 | 97 | 1.02 | 0.94 | 92 | 1.02 | 0.91 | 89 |
| 5 | 1.00 | 1.00 | 0.98 | 98 | 1.00 | 0.91 | 91 | 1.00 | 0.90 | 90 |
| 6 | 1.00 | 1.00 | 0.95 | 95 | 1.00 | 0.92 | 92 | 1.00 | 0.91 | 91 |
| 7 | 1.02 | 1.02 | 0.96 | 94 | 1.02 | 0.91 | 89 | 1.02 | 0.94 | 92 |
| 8 | 1.01 | 1.01 | 0.90 | 89 | 1.01 | 0.91 | 90 | 1.01 | 0.94 | 93 |
| Comparative Example 1 | | | | | | | | | | |
| 9 | 0.96 | 0.96 | 0.76 | 79 | 0.96 | 0.71 | 74 | 0.96 | 0.69 | 72 |
| 10 | 0.97 | 0.97 | 0.76 | 78 | 0.97 | 0.71 | 73 | 0.97 | 0.69 | 71 |
| 11 | 0.98 | 0.98 | 0.74 | 75 | 0.98 | 0.69 | 70 | 0.98 | 0.72 | 73 |
| Comparative Example 2 | | | | | | | | | | |
| 12 | 0.95 | 0.95 | 0.48 | 51 | 0.95 | 0.60 | 63 | 0.95 | 0.49 | 52 |
| 13 | 0.97 | 0.97 | 0.49 | 51 | 0.97 | 0.63 | 65 | 0.97 | 0.51 | 53 |

Note (1): Dynamic color developing density; Image density recorded using the Toshiba Thermal Facsimile KB-4800 at an applied voltage of 18.03 V and a pulse width 3.2 milliseconds is measured by a Macbeth densitometer (RD-914, an amber filter used).

Note (2): Heat resistance: Thermal paper sample dynamic-recorded by the method (1) is allowed to stand under a dry condition at 60° C. for 24 hours, and the recorded portion is measured by the Macbeth densitometer. The retention is calculated by the following equation.

Equation 1

$$\text{Retention (\%)} = \frac{\text{Image density after heat treatment}}{\text{Density of untreated image}} \times 100\%$$

Note (3): Water resistance: Thermal paper sample dynamic-recorded by the method (1) is immersed in cold water at 20° C. for 24 hours, dried, and the recorded portion is measured by the Macbeth densitometer. The retention is calculated by the following equation.

Equation 2

$$\text{Retention (\%)} = \frac{\text{Image density after water treatment}}{\text{Density of untreated image}} \times 100\%$$

Note (4): Salad oil is dropped onto thermal paper dynamic-recorded by the method (1), after 10 seconds, the oil is lightly wiped out by filter paper, allowed to stand at room temperature for 1 hour, and the image density is measured by the Macbeth densitometer.

The retention is calculated by the following equation.

Equation 3

$$\text{Retention (\%)} = \frac{\text{Image density after oil treatment}}{\text{Density of untreated image}} \times 100\%$$

In Table 1, sensitizers A to E are the following.

A:

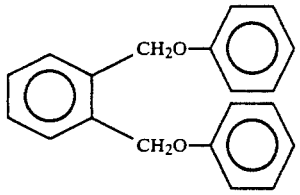

B:

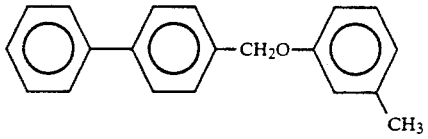

-continued

C:

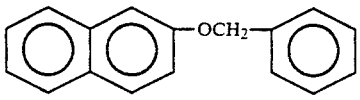

D:

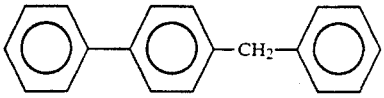

-continued

E: 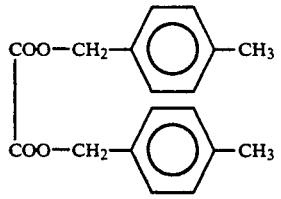

The effects of the present invention are as follows:

(1) With superior heat response, a sharp, high-density image can be obtained even in high-speed, high-density recording (high sensitivity).

(2) Almost no discoloration occurs in the printed portion (color developed portion) even when contacts with plasticizers, salad oil, vinegar, and the like (oil resistance).

(3) Almost no discoloration occurs in the printed portion even when contacts with water (water resistance).

(4) Image is stable at high temperatures (heat resistance).

We claim:

1. A thermal recording sheet provided on a substrate with a thermal color developing layer containing a colorless or pale colored basic chromogenic dye and an organic color developer as main ingredients, wherein said thermal color developing layer contains a compound of Formula (I) as a stabilizer and a compound of Formula (II) as a sensitizer:

Formula (I)

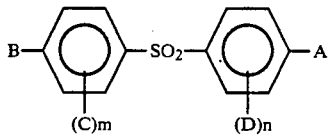

(I)

wherein A indicates

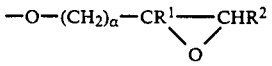

or

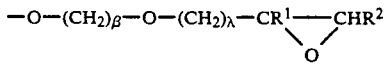

$R^1$ and $R^2$ individually indicate hydrogen or methyl; $\alpha$ is 0 or an integer from 1 to 5; $\beta$ and $\gamma$ individually indicate an integer from 1 to 5; $\beta$ indicates

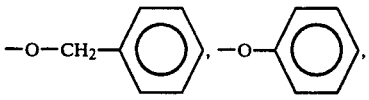

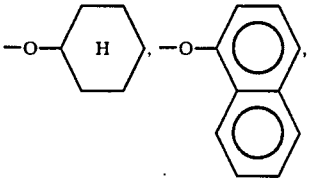

-continued

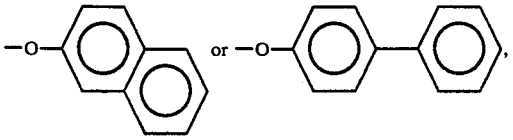

C and D individually indicate chlorine, bromine, methyl, methoxy, or ethoxy; and m and n individually indicate 0, 1, or 2; and Formula (II)

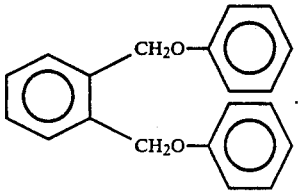

(II)

2. The thermal recording sheet of claim 1 wherein said organic color developer is diphenylsulfone of the formula:

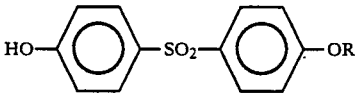

wherein R indicates propyl, isopropyl, or butyl.

3. The thermal recording sheet of claim 1 wherein 0.25 to 2.5 parts by weight of said stabilizer and 3 to 12 parts by weight of said sensitizer are used on the basis of 1 part by weight of said colorless or pale colored basic chromogenic dye.

4. The thermal recording sheet of claim 1 wherein an overcoating layer is provided on said thermal color developing layer.

5. The thermal recording sheet of claim 1 wherein an undercoating layer is provided under said thermal color developing layer.

6. A thermal recording sheet provided on a substrate with a thermal developing layer, said developing layer comprising 1.0 part by weight of a colorless or pale colored basic chromogenic dye, 1-8 parts by weight of an organic color developer; 0.25 to 2.5 parts by weight of a stabilizer compound of the Formula (I) and 3 to 12 parts by weight of a sensitizer compound of the Formula (II)

wherein said organic color developer is diphenylsulfone of the formula:

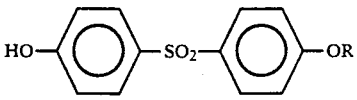

wherein R indicates propyl, isopropyl, or butyl, Formula (I) is

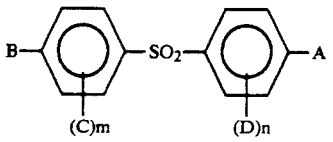

(I)

wherein A indicates

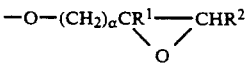

or

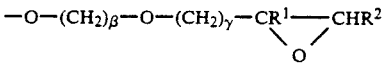

$R^1$ and $R^2$ individually indicate hydrogen or methyl; $\alpha$ is 0 or an integer from 1 to 5; $\beta$ and $\gamma$ individually indicate an integer from 1 to 5; $\beta$ indicates

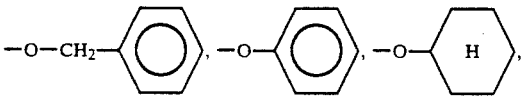

-continued

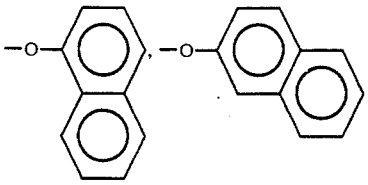

or

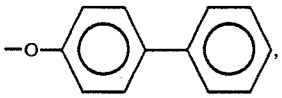

C and D individually indicate chlorine, bromine, methyl, methoxy, or ethoxy; and m and n individually indicate 0, 1, or 2; and Formula (II) is (II)

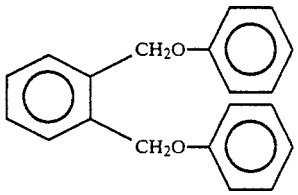

7. The thermal recording sheet of claim 6 wherein an overcoating layer is provided on said thermal color developing layer.

8. The Thermal recording sheet of claim 6 wherein an undercoating layer is provided under said thermal color developing layer.

* * * * *